US009957658B2

(12) United States Patent
Zhu et al.

(10) Patent No.: US 9,957,658 B2
(45) Date of Patent: May 1, 2018

(54) WASHING MACHINE HAVING BREATHING LAMP SET AND METHOD FOR CONTROLLING THE SAME

(71) Applicant: FOSHAN HAIER DRUM WASHING MACHINE CO., LTD., Shandong (CN)

(72) Inventors: Kai Zhu, Shando (CN); Yanli Wang, Shando (CN); Yongchao Chen, Shando (CN); Tao Huang, Shando (CN); Chunke Bi, Shando (CN)

(73) Assignee: FOSHAN HAIER DRUM WASHING MACHINE CO., LTD. (CN)

( * ) Notice: Subject to any disclaimer, the term of this patent is extended or adjusted under 35 U.S.C. 154(b) by 0 days. days.

(21) Appl. No.: 15/506,438

(22) PCT Filed: Nov. 17, 2014

(86) PCT No.: PCT/CN2014/091309

§ 371 (c)(1),
(2) Date: Feb. 24, 2017

(87) PCT Pub. No.: WO2016/029562

PCT Pub. Date: Mar. 3, 2016

(65) Prior Publication Data

US 2017/0342631 A1 Nov. 30, 2017

(30) Foreign Application Priority Data

Aug. 26, 2014 (CN) ..... 2014 1 0425001

(51) Int. Cl.

| | |
|---|---|
| ***D06F 39/00*** | (2006.01) |
| ***D06F 33/02*** | (2006.01) |
| ***H05B 37/02*** | (2006.01) |

(52) U.S. Cl.
CPC ..... *D06F 39/005* (2013.01); *D06F 33/02* (2013.01); *H05B 37/0281* (2013.01)

(58) Field of Classification Search
CPC .... D06F 39/005; D06F 33/02; H05B 37/0281
(Continued)

(56) References Cited

U.S. PATENT DOCUMENTS

2010/0147338 A1* 6/2010 Busing ..... A47L 15/4293 134/56 D
2011/0279281 A1* 11/2011 Han ..... D06F 39/005 340/679

(Continued)

FOREIGN PATENT DOCUMENTS

CN 203113095 U 8/2013
CN 203639715 U 6/2014

(Continued)

*Primary Examiner* — Hirdepal Singh
(74) *Attorney, Agent, or Firm* — Burns & Levinson, LLP; Joseph M. Maraia

(57) ABSTRACT

A washing machine having a breathing lamp set and a method for controlling the same are provided. The breathing lamp set is disposed on an outer wall or inner wall of a housing of the washing machine and is composed of a plurality of breathing lamps. The washing machine further includes a controller, configured to change, according to work process changes of the washing machine, a quantity ratio of lighted breathing lamps to dimmed breathing lamps among the plurality of breathing lamps in the breathing lamp set. The method for controlling the washing machine having the breathing lamp set includes step S1: changing, by the controller, the quantity ratio of lighted breathing lamps to dimmed breathing lamps among the plurality of breathing lamps in the breathing lamp set, so as to discriminately display different work states of the washing machine.

2 Claims, 7 Drawing Sheets

(58) Field of Classification Search
USPC ..... 340/679
See application file for complete search history.

(56) References Cited

U.S. PATENT DOCUMENTS

| | | | | |
|---|---|---|---|---|
| 2013/0047459 | A1* | 2/2013 | Geer | F26B 25/22 34/467 |
| 2013/0320862 | A1* | 12/2013 | Campbell | H05B 37/02 315/152 |
| 2017/0061749 | A1* | 3/2017 | Conard | D06F 39/005 |
| 2017/0145612 | A1* | 5/2017 | Zattin | D06F 33/02 |

FOREIGN PATENT DOCUMENTS

| | | | | |
|---|---|---|---|---|
| EP | 1582619 | A1 * | 10/2005 | D06F 37/00 |
| KR | 20030060543 | A | 7/2003 | |

* cited by examiner

WASHING MACHINE HAVING BREATHING LAMP SET AND METHOD FOR CONTROLLING THE SAME

CROSS-REFERENCES TO RELATED APPLICATIONS

This application is a national phase application under 35 U.S.C. Section 371 filed from International Patent Application PCT/CN2014/091309, filed on Nov. 17, 2014 which claims priority to Chinese patent application No. 201410425001.0 filed on Aug. 26, 2014. The contents of these applications are incorporated herein by reference in their entireties.

TECHNICAL FIELD

The present disclosure relates to the field of displaying of washing machines, in particular relates to a washing machine having a breathing lamp set and a method for controlling the same.

BACKGROUND

In an existing technology, an operating state of a washing machine is generally displayed by a combination of indicator lamps, characters, numerals and the like. As shown in FIG. 1, an entire outer wall of a drum washing machine includes four parts: a housing 11, a door body 12, an upper cover plate 13 and a control panel 14. A front end of the housing 11 is a front plate 111. The door body 12 is disposed on the front plate 111 of the housing 11. The upper cover plate 13 is disposed above the housing 11, and the control panel 14 is disposed at a front end of the housing 11 and positioned at an upper end of the front plate 111.

The control panel 14 is configured to realize various important functions such as manipulation and indication, for example, selecting a washing program and displaying operating states and the like. The control panel 14 is provided with a function selection knob 141, a power button 142, a remaining time display area 143 and an operation state display area 144, which are used for realizing different functions respectively. The operating status display area 144 is generally composed of an indicator lamp 1441 and a textual description sub-area 1442. When the washing machine runs to a certain state (for example, rinsing), an indicator lamp next to the text describing the state is lighted, so as to inform a user of the current operating state of the washing machine. In addition, although the existing washing machine is provided with the remaining time display area, the remaining time display area usually displays the remaining time to the user by means of a monotonous numeral.

The display effects of the above display manner are not desirable. For example, if a distance between the user and the washing machine is very long, the user cannot see which group of indicator lamp and description text in the operation state display area is lighted, and cannot see the numeral displayed in the remaining time display area, because a font of the description text corresponding to the indicator lamp is too small. As a result, the user fails to know the current operating state of the washing machine, and cannot make appropriate measures in time, which is very inconvenient.

Secondly, although the display effect of the operating state and remaining time of the washing machine of the existing technology is intuitional, a rhythm is rigid and stiff, lacks dynamism and visual impact, not vivid and natural, and is hardly to be integrated into an intelligent concept of the product.

Based on the above description, there is an urgent need for a washing machine with a new display device for the operating state and the remaining time, and a control method for the same, so as to solve the following problem of the existing art: if the user is too far away from the washing machine, he/she is unable to see which group of indicator lamp and description text in the operation state display area is lighted, and unable to see the numeral displayed in the remaining time display area, thus fails to learn the current operating state of the washing machine.

SUMMARY

In view of the above, the present disclosure provides a washing machine having a breathing lamp set, which allows the user to grasp the current operating state of the washing machine even if the user is far from the washing machine, and is easy to use.

The present disclosure further provides a method for controlling the washing machine having a breathing lamp set. According to the method, the washing operation time is displayed through breathing lamps, so that the user is able to roughly deduce the remaining operation time according to the operating state of the breathing lamps even if the user is in a remote range where the display screen of the washing machine cannot be seen.

Embodiments of the present disclosure adopt the following technical schemes:

A washing machine having a breathing lamp set is provided. The breathing lamp set is disposed on an outer wall or an inner wall of a housing of the washing machine and is composed of a plurality of breathing lamps; the washing machine further comprises a controller, configured to change a quantity ratio of lighted breathing lamps to dimmed breathing lamps among the plurality of breathing lamps in the breathing lamp set according to a work process change of the washing machine.

Preferably, a light guide is disposed between two adjacent breathing lamps.

Preferably, the work process change specifically is a change in a ratio of ran time to a total running time of a selected program, or a change in a ration of remaining time to the total running time of the selected program.

Preferably, the breathing lamp set is disposed on a periphery of an inner side of a door body of the washing machine, a control panel and/or a front plate of the housing.

Preferably, the breathing lamp set is of a strip shape, a ring shape, a sector shape, an elliptic shape, or a circular shape.

A method for controlling a washing machine having a breathing lamp set, applied to any washing machine having a breathing lamp set described above, includes step S1, changing, by the controller, the quantity ratio of lighted breathing lamps to dimmed breathing lamps among the plurality of breathing lamps in the breathing lamp set, so as to discriminately display different work states of the washing machine.

Preferably, the step S1 comprises the following steps:

S111, calculating, by the controller, number n of breathing lamps to be lighted when the work process reaches ΔT stage according to the following formula:

$n=\Delta T*N/T0$, where T0 denotes total running time of the selected program, ΔT denotes ran time of the selected program, and N denotes a total number of the breathing lamps; and S112, after the work program being started, lighting n breathing lamps by the controller when the work process reaches ΔT stage.

Preferably, in the step S112, the N breathing lamps form a ring, n adjacent breathing lamps are lighted by the controller when the work process reaches ΔT stage, the remained N-n breathing lamps are dimmed or turned off.

Preferably, the step S1 comprises the following steps:

S121, calculating, by the controller, number n of breathing lamps to be dimmed or turned off when the work process reaches ΔT stage according to the following formula:

$n=\Delta T*N/T0$, where T0 denotes the total running time of the selected program, ΔT denotes the remaining time of the selected program, and N denotes the total number of the breathing lamps;

S122, after the work program being started, dimming or turning off, by the controller, n breathing lamps when the work process reaches ΔT stage.

The technical solutions proposed by the embodiments of the present disclosure have the following beneficial technical effects.

The breathing lamp set provided by the present disclosure is provided on the outer wall or the inner wall of the housing of the washing machine and is composed of a plurality of breathing lamps, the washing machine further includes a controller configured to control changes of a quantity ratio of lighted breathing lamps to dimmed breathing lamps among the breathing lamps in the breathing lamp set according to a work process change of the washing machine. Therefore, it is easy to observe the lighted/dimmed status of the breathing lamps. The method for controlling the washing machine having the breathing lamp set includes step S1: changing, by the controller, the quantity ratio of lighted breathing lamps to dimmed breathing lamps among the breathing lamps in the breathing lamp set, so as to discriminately display different work states of the washing machine. As a result, with the washing machine and the method for controlling the same, the user can roughly deduce the real time operating state of the washing machine easily according to the quantity ratio of lighted breathing lamps to dimmed lights among the breathing lamp set, even if the user is in a remote range where the user cannot see the display screen of the washing machine. At the same time, the user can clearly see the operating progress of the program of the washing machine, especially when the time remained before the end of the program, thereby improving the user's experience and enhancing the aesthetic effect.

BRIEF DESCRIPTION OF DRAWINGS

For explaining the technical solutions of the embodiments of the present disclosure more clearly, the accompanying drawings which are used in the description of the embodiments of the present disclosure will be briefly described hereinafter. Apparently, the accompanying drawings described below are only parts of embodiments of the present disclosure. Those skilled in the art can obtain other drawings according to the contents and accompanying drawings of the embodiments of the present invention without paying any inventive effort.

Figure 1:
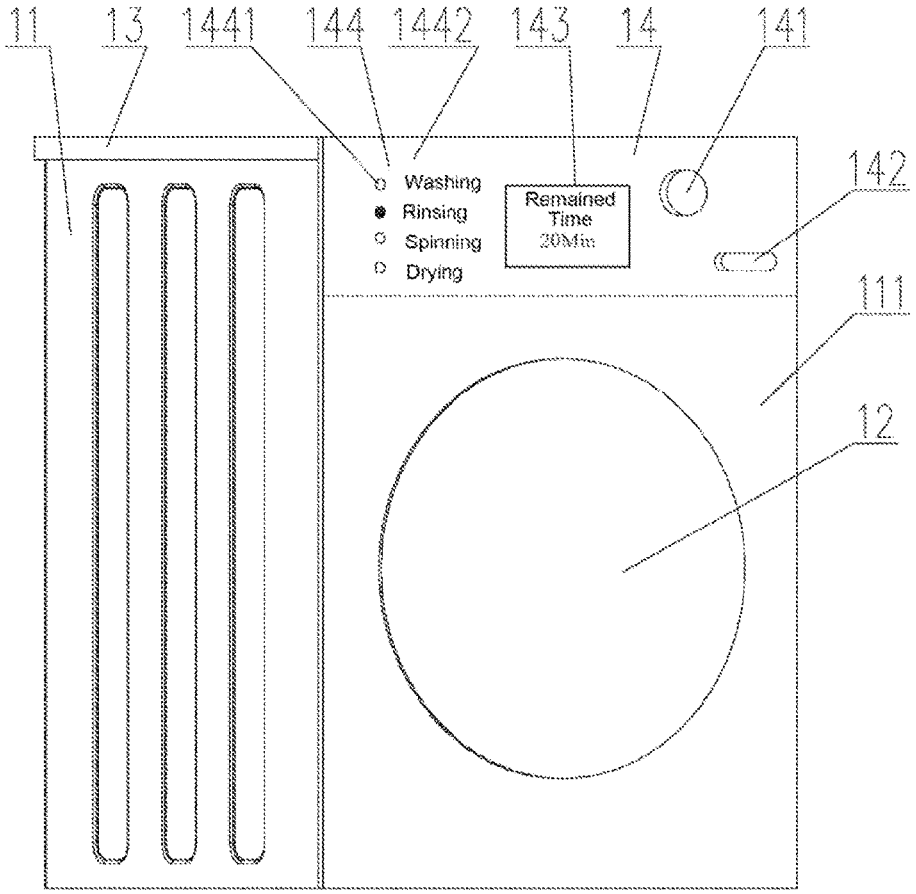
FIG. 1 is a schematic diagram showing an external structure of a washing machine of the existing technology.

Reference numerals in the drawings:

11 housing; 12 door body; 13 upper cover plate; 14 control panel;

111 front plate;

141 function selection knob; 142 power button; 143 remaining time display area; 144 operation state display area;

1411 indicator lamp; 1442 textual description sub-area;

21 housing; 22 door body; 23 upper cover plate; 24 control panel; 25 breathing lamps;

211 front plate;

241 function selection knob; 242 power button; 243 remaining time display area; 244 operation state display area;

2441 indicator lamp; 2442 textual description sub-area;

251 dimmed area; 252 lighted area;

31 housing; 32 door body; 34 control panel; 35 breathing lamps;

311 front plate;

41 housing; 42 door body; 44 control panel; 45 breathing lamps;

411 front plate;

51 housing; 52 door body; 54 control panel; 55 breathing lamps;

511 front plate;

61 housing; 62 door body; 64 control panel; 65 breathing lamps;

611 front plate.

DETAILED DESCRIPTION

In order to make the technical problem, technical solution and technical effect of the present disclosure more clear, the technical solution of the embodiments of the present disclosure will be described in detail with reference to accompanying drawings. Apparently, the embodiments described below are only parts of embodiments of the present disclosure rather than all embodiments. All other embodiments obtained by those skilled in the art based on the embodiments of the present disclosure without paying inventive effort fall in the scope of protection of the present disclosure.

The present disclosure provides a washing machine having a breathing lamp set. The breathing lamp set is disposed on an outer wall or an inner wall of a housing of the washing machine and is composed of a plurality of breathing lamps. The washing machine further includes a controller configured to change a quantity ratio of lighted breathing lamps to dimmed breathing lamps among the breathing lamps in the breathing lamp set according to a work process change of the washing machine. With the washing machine, the user can roughly deduce a real time operating state of the washing machine easily according to the quantity ratio of the lighted breathing lamps to the dimmed breathing lamps in the breathing lamp set, even if the user is in a remote range where the user cannot see the display screen of the washing machine. At the same time, the user can clearly observe an operating progress of the program of the washing machine, especially the time remained before the end of the program, thereby improving the user's experience and enhancing the aesthetic effect.

In the disclosure, as a preferable embodiment, the work process change of the washing machine specifically refers to a change in a ratio of ran time to total running time of a selected program, or a change in a ratio of remaining time to the total running time of the selected program.

For example, all the breathing lamps are dimmed or turned off when the work program is not started. As the work process proceeds, the number of the breathing lamps which are dimmed or turned off decreases gradually, the number of lighted breathing lamps increases gradually. All the breathing lamps are in a status of being lighted till the entire work process is completed. Alternatively, all the breathing lamps are lighted when the work program is not started, as the work process proceeds, the number of lighted breathing lamps decreases gradually and the number of breathing lamps which are dimmed or turned off increases gradually, all the breathing lamps are in a state of being dimmed or turned-off till the entire work process is completed.

The work program is determined according to the user's selection. A washing process, a rinsing process and a drying process may constitute a whole work program. A single washing process, or a single rinsing process, or a single drying process may also be referred to as a work program.

Taking a situation that a washing process, a rinsing process and a drying process constitute a whole work program, as an example, it is assumed that the time for completing the whole work program is 30 min, the time for completing the washing process is 15 min, the time for completing the rinsing process is 10 min, and the time for completing the drying process is 5 min. In this case, all the breathing lamps are dimmed or turned off when the work program is not started; the lighted breathing lamps account for a half of the total breathing lamps in the breathing lamp set when the washing process is completed; the lighted breathing lamps account for five-sixths of the total breathing lamps in the breathing lamp set when the rinsing process is completed; and all the breathing lamps are in the state of being lighted when the drying process is completed, which indicates that the whole work program is completed.

Hereinafter, the washing machine having a breathing lamp set will be described through five apparatus embodiments.

Apparatus Embodiment I

Figure 2:
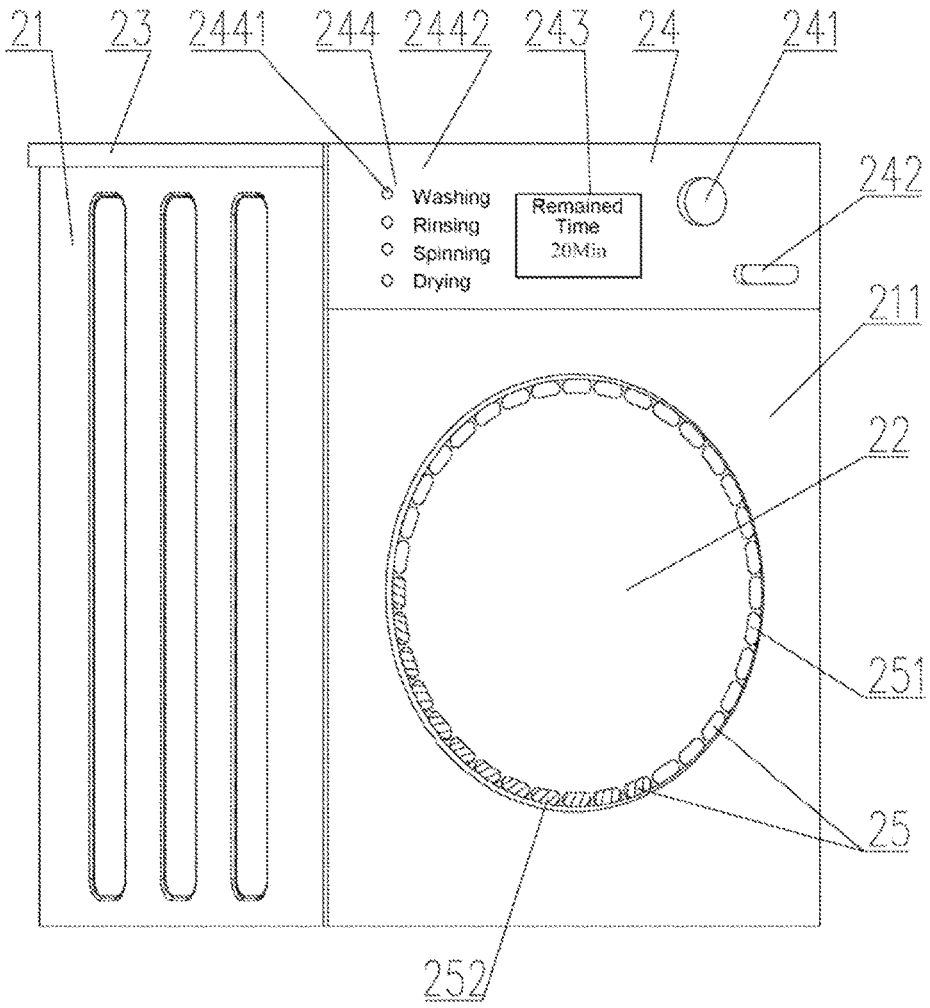
FIG. 2 is a diagram showing a luminescence status of the breathing lamps when a washing program runs for a quarter of a total time according to apparatus embodiment I of the present disclosure.
Figure 3:
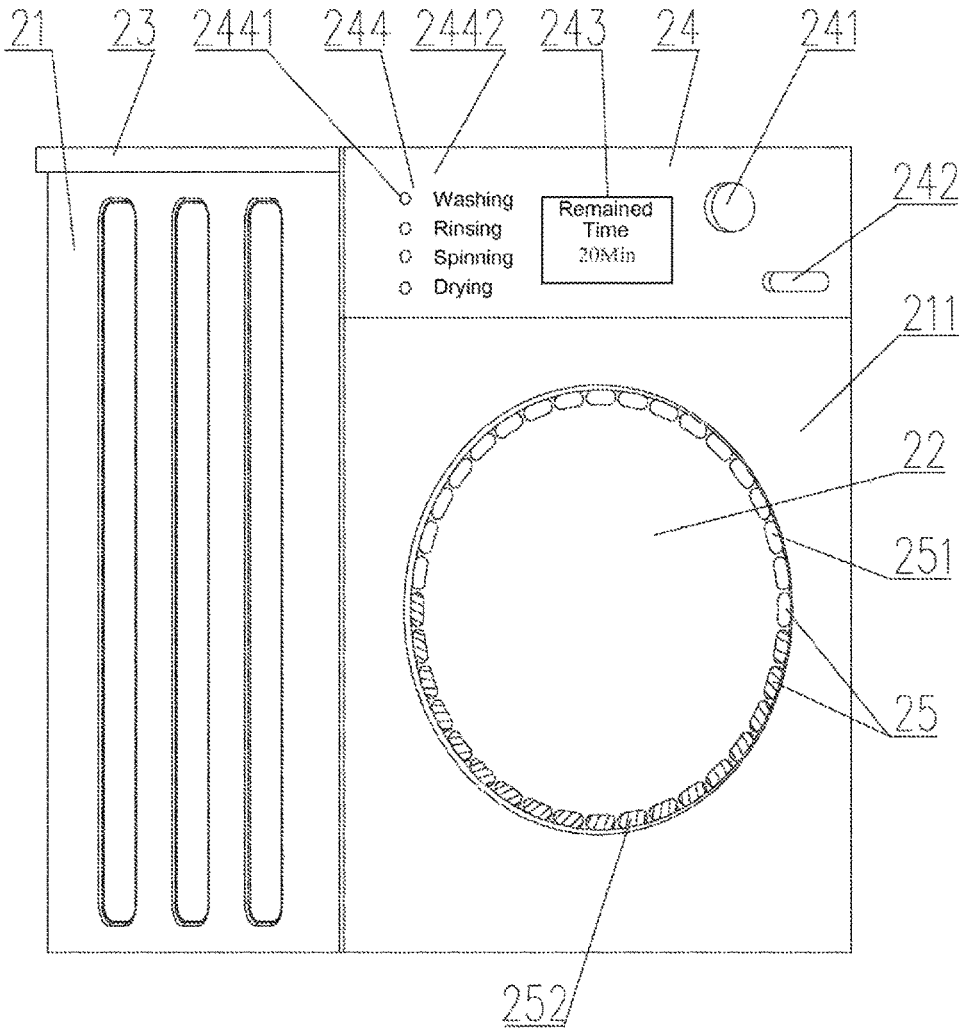
FIG. 3 is a diagram showing a luminescence status of the breathing lamps when the washing program runs for a half of the total time according to the apparatus embodiment I of the present disclosure.

As shown in FIG. 2 and FIG. 3, the washing machine having a breathing lamp set provided by the present disclosure includes a housing 21, a door body 22, an upper cover plate 23 and a control panel 24. The upper cover plate 23 is disposed on an upper end of the housing 21. A front end of the housing 21 is a front plate 211. The door body 22 is disposed in the front plate 211 of the housing 21. The door body 22 is a circular door body. The control panel 24 is disposed at the front end of the housing 21 and above the front plate 211.

The control panel 24 is provided with a function selection knob 241, a power button 242 and an operation state display area 244. In the present embodiment, as a preferred solution, the operation state display area 244 is composed of an indicator lamp 2441 and a textual description sub-area 2442 corresponding to the indicator lamp 2441. That is, each indicator lamp 2441 corresponds to a textual description.

Besides the above components, the washing machine is further provided with a breathing lamp set that is ring-shaped. The ring-shaped breathing lamp set is disposed at a periphery of an inner side of the door body 22. The ring-shaped breathing lamp set is composed of several breathing lamps 25 which are evenly arranged in sequence according to a certain rule, each of them is connected to the controller. The controller is configured to control the breathing lamps 25 to be turned on or turned off.

Specifically, after the washing machine is powered on, the ring-shaped breathing lamps at the periphery of the inner side of the door body 22 will be dimmed but not turned off. When a certain washing program of the washing machine is selected and activated, the ring-shaped breathing lamps at the periphery of the inner side of the door body 22 will be lighted gradually from a certain position of the periphery of the inner side of the door body 22 as the washing program proceeds, until the maximum brightness is maintained. For example, FIG. 2 shows the luminescence status of the breathing lamps when the washing program has ran for one quarter of the total time. In FIG. 2, a dimmed area 251 accounts for three quarters of a length of the whole breathing lamp set, a lighted area 252 accounts for one quarter of the length of the whole breathing lamp set, indicating that one quarter of the washing program is carried out, and three quarters of the washing program are to be carried out. Therefore, the user may calculate the remaining washing time required for completing the washing program according to the total time required for carrying out the program. FIG. 3 shows the luminescence status of the breathing lamps when the washing program has ran for a half of the total time. In FIG. 3, the dimmed area 251 accounts for a half of the length of the whole breathing lamp set, the lighted area 252 accounts for a half of the length of the whole breathing lamp set, indicating that a half of the washing program is carried out, and the other half of the washing program are to be carried out. In this way, the user can roughly deduce the remaining washing time of the washing machine easily according to the luminescence status of the breathing lamps, even if the user is in a remote range where the user cannot see the display screen of the washing machine.

In the present embodiment, as a preferred solution, a light guide is disposed between two adjacent breathing lamps 25. The ends of the light guide contact the two breathing lamps 25 respectively. The light guide can conduct the light emitted by the breathing lamps 25, so that the number of breathing lamps 25 required for constituting the breathing lamp set of a same length is reduced, the breathing lamps 25 are saved, and the control process of the controller is easier.

The dedicated remaining time display function arranged in the control panel of the existing washing machine is not essential in the present solution. In order to ensure the accuracy of the reminder of the remaining time, in the present embodiment, as a preferred solution, the control panel 24 is still provided with a remaining time display area 243 for displaying the remaining time of the washing program.

Apparatus Embodiment II

The breathing lamps are arranged at the periphery of the door body in the above apparatus embodiment I. However, the positions of the breathing lamps are not limited by the above embodiment I. The breathing lamps may also be arranged at other parts of the washing machine.

Figure 4:
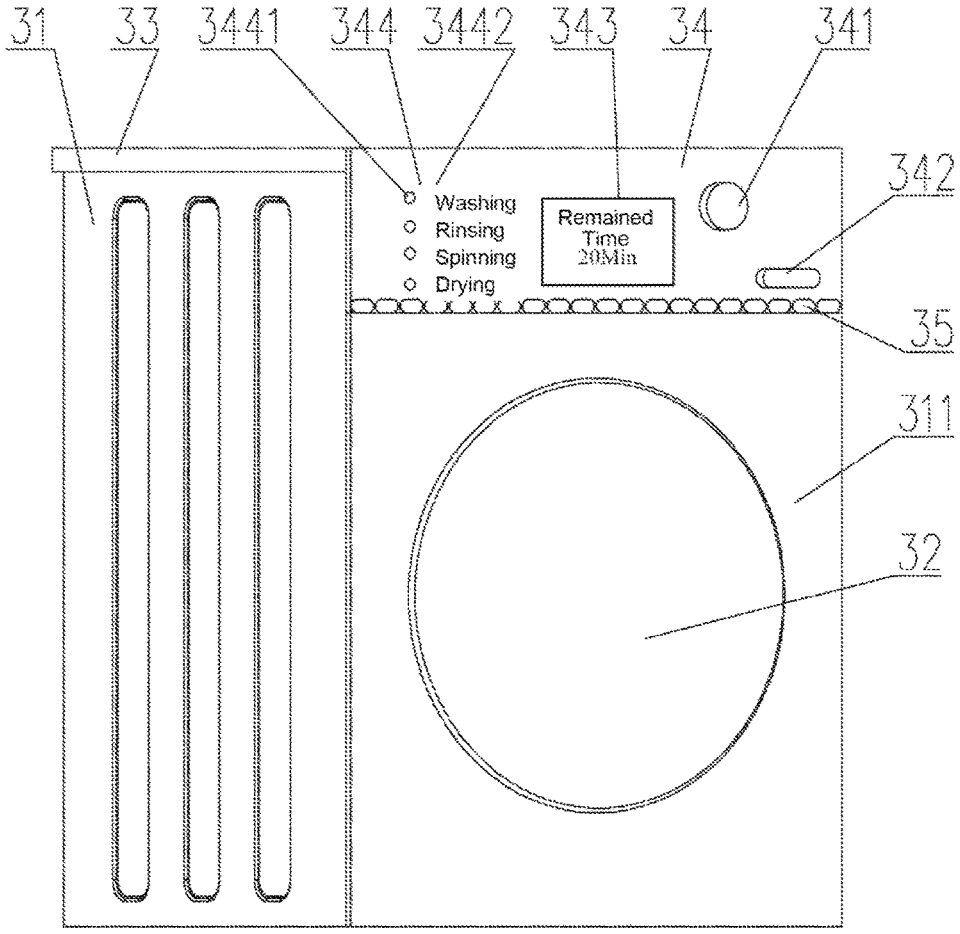
FIG. 4 is a schematic diagram showing a structure of a washing machine provided by apparatus embodiment II of the present disclosure, in which a breathing lamp set is located at a bottom edge of a control panel.

In the present embodiment, as shown in FIG. 4, a door body 32 is provided at a center of a front plate 311 of a housing 31 of a washing machine. A front end of the housing 31 is provided with a control panel 34, and the control panel 34 is above the front plate 311. The washing machine of the present embodiment is also provided with a breathing lamp set. Unlike apparatus embodiment I, in the present embodiment, the breathing lamp set is composed of several breathing lamps 35 arranged in a strip, which are disposed at the bottom edge of the control panel 34.

Apparatus Embodiment III

Figure 5:
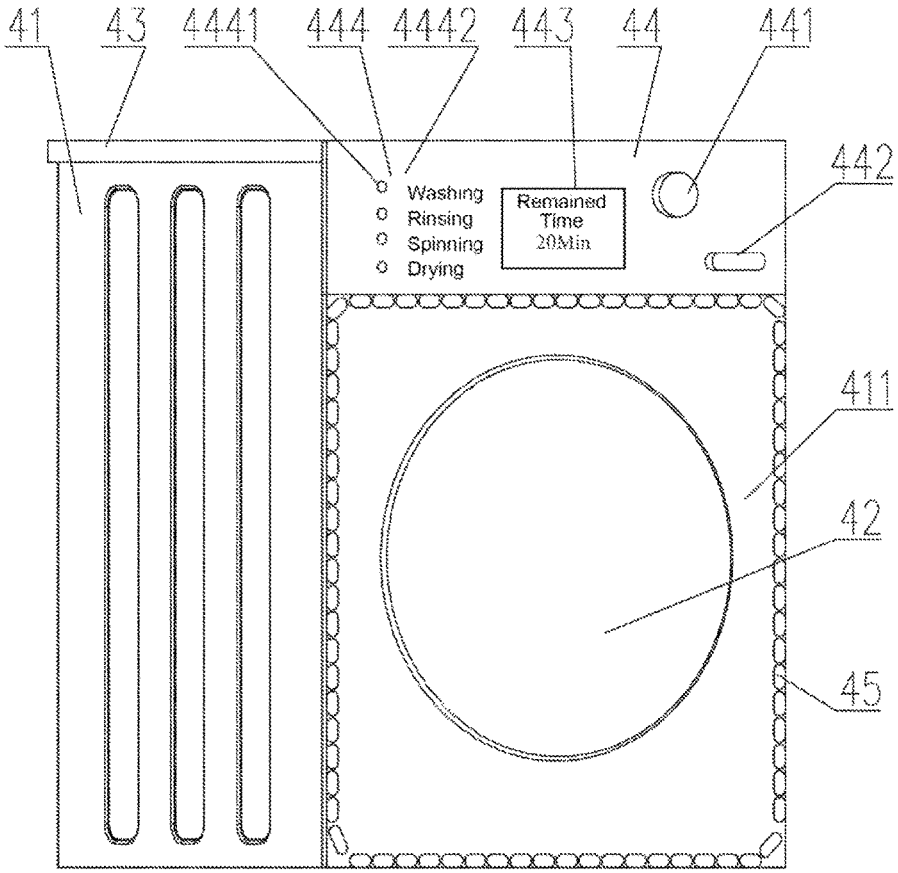
FIG. 5 is a schematic diagram showing a structure of a washing machine provided by apparatus embodiment III of the present disclosure, in which the breathing lamp set is located at a periphery of a front plate of a housing.

In the present embodiment, as shown in FIG. 5, a door body 42 is provided at a center of a front plate 411 of the washing machine. A front end of the housing 41 is provided with a control panel 44, and the control panel 44 is above the front plate 411. The washing machine of the present embodiment is also provided with a breathing lamp set. Unlike apparatus embodiments I and II, in the present embodiment, the breathing lamp set is composed of several breathing lamps 45 arranged in a rectangle, which are disposed at a periphery of the front plate 411 of the housing 41.

Apparatus Embodiment IV

Figure 6:
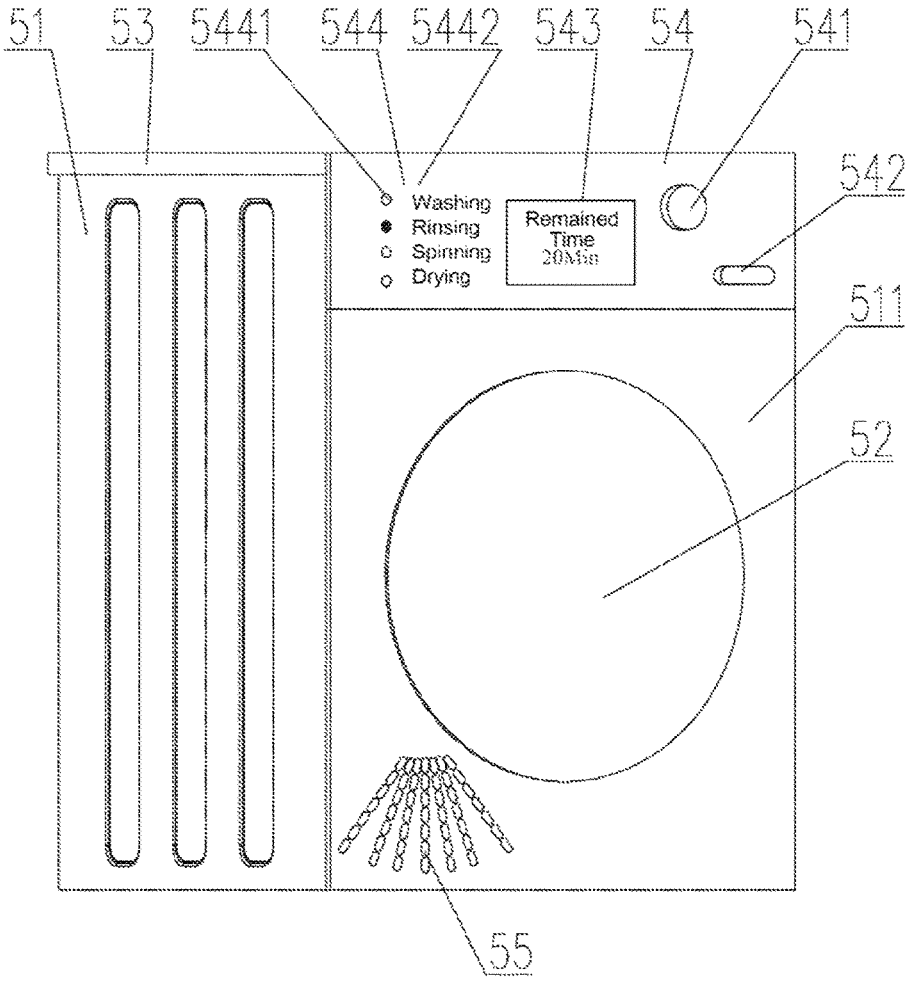
FIG. 6 is a schematic diagram showing a structure of a washing machine provided by apparatus embodiment IV of the present disclosure, in which the breathing lamp set is arranged in a sector.

In the present embodiment, as shown in FIG. 6, a door body 52 is provided at a center of a front plate 511 of a housing 51 of the washing machine. A front end of the housing 51 is provided with a control panel 54, and the control panel 54 is above the front plate 511. The washing machine of the present embodiment is also provided with a breathing lamp set. Unlike apparatus embodiments I and II, in the present embodiment, the breathing lamp set is composed of several breathing lamps 55 arranged in a sector, which are disposed at a lower-left corner of the front plate 511 of the housing 51.

Apparatus Embodiment V

Figure 7:
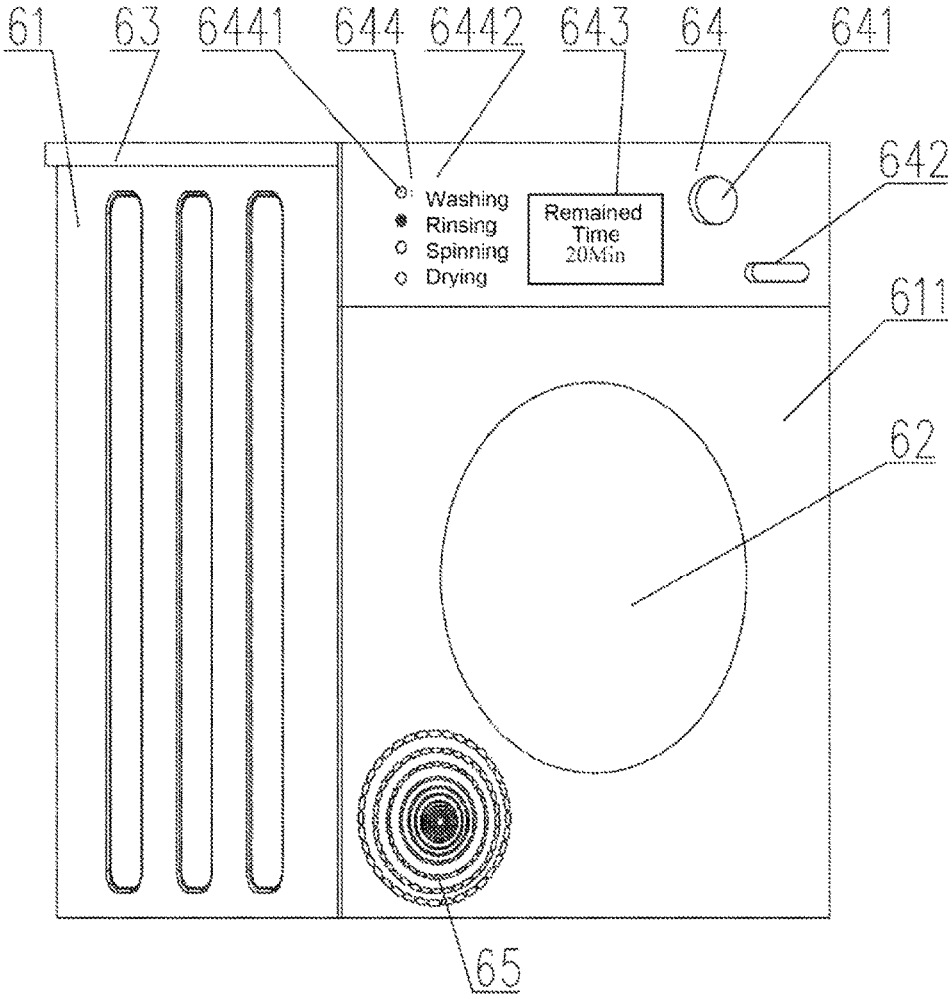
FIG. 7 is a schematic diagram showing a structure of a washing machine provided by apparatus embodiment V of the present disclosure, in which the breathing lamp set is arranged in a circle.

In the present embodiment, as shown in FIG. 7, a door body 62 is provided at a center of a front plate 611 of a housing 61 of the washing machine. A front end of the housing 61 is provided with a control panel 64, and the control panel 64 is above the front plate 611. The washing machine of the present embodiment is also provided with a breathing lamp set. Unlike apparatus embodiments I and II, in the present embodiment, the breathing lamp set is circular and includes several ring-shaped breathing lamp sub sets of different diameters arranged from inside to outside. The ring-shaped breathing lamp sub sets have a same center. Each of the ring-shaped breathing lamp sub sets is composed of several breathing lamps 65 connected in sequence. The circular breathing lamp set is disposed at a lower-left corner of the front plate 611 of the housing 61. Alternatively, the breathing lamp set may be elliptic and composed of several breathing lamp sub sets in an elliptic ring shape arranged from inside to outside.

In the present embodiment, the shape of the breathing lamps is not limited to the above five configurations, and may be other shapes. The position of the breathing lamps on the outer wall of the washing machine is not limited to the positions of the above five scheme. As long as the user is able to roughly deduce the remaining washing time of the washing machine according to the luminescence status of the breathing lamps, the structure and position of the breathing lamps fall into the protection scope of the present disclosure.

A method for controlling a washing machine having a breathing lamp set is also provided by the present disclosure. The method is applied to any washing machine having the breathing lamp set provided by the above apparatus embodiments. The method for controlling the washing machine having the breathing lamp set includes step S1:

a quantity ratio of lighted breathing lamps to dimmed breathing lamps among the breathing lamps in the breathing lamp set is changed by the controller, so as to discriminately display different work states of the washing machine.

The method will be described below by means of two embodiments.

Method Embodiment I

In the present embodiment, step S1 includes the following steps:

S111, the number n of breathing lamps to be lighted when the work process reaches ΔT stage is calculated by the controller according to the following formula:

$n=\Delta T*N/T0$, where T0 denotes a total running time of a selected program, ΔT denotes ran time of the selected program, and N denotes a total number of the breathing lamps;

S112, after the work program being started, n breathing lamps are lighted by the controller when the work process reaches ΔT stage.

All the breathing lamps are dimmed or turned off when the work program is not started. As the work process proceeds, the number of breathing lamps which are dimmed or turned off decreases gradually, the number of lighted breathing lamps increases gradually. All the breathing lamps are in a status of being lighted till the entire work program is completed.

Reflected in step S112, specifically, taking the situation that the N breathing lamps are arranged in a ring shape as an example, during a period that the work program is started and the work process has not reached the ΔT stage, n adjacent breathing lamps are lighted by the controller according to a preset order. Meanwhile, the remained N-n breathing lamps are dimmed or turned off. It can be deduced that the work program is completed when all the breathing lamps are lighted and the breathing lamp set maintains the maximum brightness.

Taking a situation that the work program is a washing process as an example, it is assumed that the time required for completing the whole washing process is 30 min. In this case, all the breathing lamps are dimmed or turned off when the work program is not started. The number of lighted breathing lamps accounts for one third of the number of breathing lamps of the whole breathing lamp set when the washing process has ran 10 min. The number of the lighted breathing lamps accounts for two thirds of the number of breathing lamps of the whole breathing lamp set when the washing process has ran 20 min. All the breathing lamps are in a state of being lighted when the washing process has ran 30 min, which indicates the whole work program is completed.

In the present embodiment, in step S112, n breathing lamps are lighted by the controller according to a preset order before the work process reaches the ΔT stage. For example, at least one breathing lamp is lighted each time as long as the n breathing lamps are evenly lighted in sequence before the work process reaches the ΔT stage.

In the present embodiment, taking the shape and position of the breathing lamps in apparatus embodiment I or apparatus embodiment III as an example, the breathing lamps may be sequentially lighted from a certain breathing lamp in a clockwise direction or a counterclockwise direction. Alternatively, the breathing lamps may be sequentially lighted from a certain breathing lamp in the clockwise direction and the counterclockwise direction.

Taking the shape and position of the breathing lamps disclosed in apparatus embodiment II as an example, the breathing lamps may be sequentially lighted from the first breathing lamp on the left side to the right side.

Taking the shape and position of the breathing lamps disclosed in apparatus embodiment IV as an example, the breathing lamps may be sequentially lighted from a certain column of breathing lamps in the clockwise direction or in the counterclockwise direction.

Taking the shape and position of the breathing lamps disclosed in apparatus embodiment V as an example, the breathing lamps may be sequentially lighted from the most inner circle and from inside to outside.

Method Embodiment II

In the present embodiment, step S1 includes the following steps: S121, the number n of breathing lamps to be dimmed or turned off when the work process reaches ΔT stage are calculated by the controller according to the following formula:

$n=\Delta T*N/T0$, where T0 denotes the total running time of the selected program, ΔT denotes the remaining time of the selected program, and N denotes the total number of the breathing lamps;

S122, after the work program is started, n breathing lamps are dimmed or turned off by the controller when the work process reaches ΔT stage.

All the breathing lamps are lighted when the work program is not started, at this moment, the un-running time of the work program is longest. After the work program is started, the number of lighted breathing lamps decreases gradually and the number of breathing lamps which are dimmed or turned off increases gradually with the change of the work progress. All the breathing lamps are dimmed or turned off till the work program is completed.

Reflected in step S122, specifically, taking a situation that the N breathing lamps forms a ring as an example, during a period that the work program is started and the work progress has not reached ΔT stage, n adjacent breathing lamps are dimed or turned off by the controller according to a preset order. Meanwhile, the remained N-n breathing lamps are lighted. It can be deduced that the work program is completed when all the breathing lamps are dimmed or turned off and the breathing lamp set maintains the minimum brightness.

In the present embodiment, in step S122, the n breathing lamps are dimmed or turned off by the controller according to a preset order before the work progress reaches ΔT stage. For example, at least one breathing lamps may be dimmed or turned off each time as long as n breathing lamps may be evenly dimmed or turned off in sequence before the work progress reaches ΔT stage.

The order in which the breathing lamps are dimmed or turned off is the same as the order of lighting the breathing lamps in method embodiment I, and is not described here.

The method for controlling a washing machine having a breathing lamp set provided by the present disclosure is applied to the washing machine having a breathing lamp set. Therefore, the control method includes step S1: the quantity ratio of lighted breathing lamps to dimmed breathing lamps among the breathing lamps in the breathing lamp set is changed by the controller, so as to discriminately display different work programs of the washing machine.

Therefore, with the washing machine, the user can roughly deduce the real time operating state of the washing machine easily according to the quantity ratio of lighted breathing lamps to dimmed lights among the breathing lamps in the breathing lamp set, even if the user is in a remote range where the user cannot see the display screen of the washing machine. At the same time, the user can clearly observe the operating progress of the program of the washing machine, especially the time remained before the end of the program, thereby improving the user's experience and enhancing the aesthetic effect.

Meanwhile, a flexible display of the working state of the washing machine is achieved by controlling the length of lighted breathing lamps during the operating process of the washing machine. In addition to reminding the remaining washing time, the breathing lamp set provided on the washing machine plays a very good visual decorative effect. The gradual change of the breathing lamps from bright to dark, like breathing, can provide visual prompts, and play a very good visual decorative effect, thereby increasing user's experience, giving the washing machine a beautiful fashion and high intelligence appearance, and improving the flexibility and convenience of determining and reminding the washing state of the washing machine and the remaining washing time, which is vivid, natural and endowed with vitality.

It is noted that the above is only preferred embodiments of the present disclosure and the technical principle applied thereto. It is understood by those skilled in the art that the present disclosure is not limited to the specific embodiments described herein. Various other apparent changes, rearrangements and substitutions made by those skilled in the art fall in the protection scope of the disclosure. Thus, although the present disclosure has been described in detail by means of the above embodiments, the present disclosure is not limited to the above embodiments. The present disclosure may be embodied in other equivalent forms without departing from the scope of the present disclosure. The scope of the present disclosure is determined by the appended claims.

What is claimed is:

1. A method for controlling a washing machine having a breathing lamp set, the method applied to the washing machine having the breathing lamp set, wherein the breathing lamp set is composed of a plurality of breathing lamps; the washing machine further comprises a controller, configured to change a quantity ratio of lighted breathing lamps to dimmed breathing lamps among the plurality of breathing lamps in the breathing lamp set according to a change of a work program of the washing machine, and wherein the work program includes a washing process, a rinsing process and a drying process, the quantity ratio of lighted breathing lamps to dimmed breathing lamps among the plurality of breathing lamps in the breathing lamp set is changed to a first ratio by the controller in the washing process, the quantity ratio of lighted breathing lamps to dimmed breathing lamps among the plurality of breathing lamps in the breathing lamp set is changed to a second ratio by the controller in the rinsing process, and the quantity ratio of lighted breathing lamps to dimmed breathing lamps among the plurality of breathing lamps in the breathing lamp set is changed to a third ratio by the controller in the drying process, the method comprising the steps:

S1, changing, by the controller, the quantity ratio of lighted breathing lamps to dimmed breathing lamps among the plurality of breathing lamps in the breathing lamp set, to discriminately display the work program of the washing machine, wherein the work program includes the washing process, the rinsing process and the drying process, the quantity ratio of lighted breathing lamps to dimmed breathing lamps among the plurality of breathing lamps in the breathing lamp set is changed to the first ratio by the controller in the washing process, the quantity ratio of lighted breathing lamps to dimmed breathing lamps among the plurality of breathing lamps in the breathing lamp set is changed to the second ratio by the controller in the rinsing process, and the quantity ratio of lighted breathing lamps to dimmed breathing lamps among the plurality of breathing lamps in the breathing lamp set is changed to the third ratio by the controller in the drying process, wherein the step S1 further comprises the following steps:

S111, calculating, by the controller, number n of breathing lamps to be lighted when a selected work program reaches ΔT stage according to the following formula:

$n=\Delta T*N/T0$, where T0 denotes total running time of the selected work program, ΔT denotes ran time of the selected work program, and N denotes a total number of the breathing lamps; and S112, lighting, by the controller, the n breathing lamps sequentially within a time period from the selected work program being started to the selected work program reaching the ΔT stage.

2. The method for controlling the washing machine having the breathing lamp set according to claim 1, wherein in the step S112, the N breathing lamps form a ring, the n adjacent breathing lamps are lighted by the controller when the selected work program reaches the ΔT stage, the remained N-n breathing lamps are dimmed or turned off.

* * * * *